US010605034B2

(12) United States Patent
Affleck

(10) Patent No.: US 10,605,034 B2
(45) Date of Patent: Mar. 31, 2020

(54) ACTIVATING A WELL SYSTEM TOOL

(71) Applicant: Saudi Arabian Oil Company, Dhahran (SA)

(72) Inventor: Michael Affleck, Aberdeenshire (GB)

(73) Assignee: Saudi Arabian Oil Company, Dhahran (SA)

( * ) Notice: Subject to any disclaimer, the term of this patent is extended or adjusted under 35 U.S.C. 154(b) by 117 days.

(21) Appl. No.: 15/064,034

(22) Filed: Mar. 8, 2016

(65) Prior Publication Data

US 2016/0265300 A1 Sep. 15, 2016

Related U.S. Application Data

(60) Provisional application No. 62/130,212, filed on Mar. 9, 2015.

(51) Int. Cl.

| | |
|---|---|
| ***E21B 33/06*** | (2006.01) |
| ***E21B 34/06*** | (2006.01) |
| ***E21B 34/16*** | (2006.01) |
| ***E21B 47/06*** | (2012.01) |

(52) U.S. Cl.
CPC ..... *E21B 33/06* (2013.01); *E21B 34/16* (2013.01); *E21B 47/06* (2013.01); *E21B 47/065* (2013.01)

(58) Field of Classification Search
CPC ..... E21B 44/00; E21B 44/0021; E21B 33/06
See application file for complete search history.

(56) References Cited

U.S. PATENT DOCUMENTS

| | | | | |
|---|---|---|---|---|
| 4,337,653 | A | 7/1982 | Chauffe | |
| 4,413,642 | A * | 11/1983 | Smith | E21B 34/16 137/102 |
| 4,636,934 | A * | 1/1987 | Schwendemann | E21B 33/0355 137/624.18 |
| 5,955,666 | A | 9/1999 | Mullins | |
| 6,032,742 | A | 3/2000 | Tomlin et al. | |
| 6,305,471 | B1 | 10/2001 | Milloy | |
| 7,539,548 | B2 | 5/2009 | Dhawan | |

(Continued)

FOREIGN PATENT DOCUMENTS

| | | |
|---|---|---|
| CA | 2537585 | 8/2006 |
| CN | 200989202 | 12/2007 |

(Continued)

OTHER PUBLICATIONS

International Search Report and Written Opinion of the International Searching Authority issued in International Application No. PCT/US2016/021341 dated May 25, 2016; 11 pages.

(Continued)

*Primary Examiner* — Robert E Fuller
*Assistant Examiner* — Lamia Quaim
(74) *Attorney, Agent, or Firm* — Fish & Richardson P.C.

(57) ABSTRACT

A well system includes a local control unit configured to communicably couple to a well shut-in assembly at a well site, the well shut-in assembly operable to shut-in a wellbore based on a command from the local control unit; and a remote control unit configured to wirelessly communicate a line-of-sight airborne wireless signal, at a location remote from the local control unit and the well site, to initiate the command from the local control unit to the well shut-in assembly.

22 Claims, 5 Drawing Sheets

(56) References Cited

U.S. PATENT DOCUMENTS

| | | | | |
|---|---|---|---|---|
| 2004/0182574 | A1* | 9/2004 | Adnan | E21B 44/00 166/250.01 |
| 2005/0092523 | A1 | 5/2005 | McCaskill et al. | |
| 2007/0175633 | A1* | 8/2007 | Kosmala | E21B 47/0007 166/250.15 |
| 2009/0153354 | A1* | 6/2009 | Daussin | E21B 43/26 340/853.1 |
| 2012/0227983 | A1 | 9/2012 | Lymberopoulous et al. | |
| 2013/0146359 | A1* | 6/2013 | Koederitz | G01V 3/38 175/48 |
| 2014/0231075 | A1 | 8/2014 | Springett et al. | |
| 2014/0238658 | A1 | 8/2014 | Wilson et al. | |

FOREIGN PATENT DOCUMENTS

| | | |
|---|---|---|
| CN | 203232293 | 10/2013 |
| GB | 2124855 | 2/1984 |
| WO | 00/31374 | 6/2000 |
| WO | 2012007407 | 1/2012 |

OTHER PUBLICATIONS

Gulf Cooperation Council Examination Report issued in GCC Application No. 2016-30964 dated May 31, 2018, 3 pages.

Chinese Office Action issues in Chinese Application No. 201680015107.0 dated Mar. 21, 2019, 7 pages.

Gulf Cooperation Council Examination Report issued in GCC Application No. 2016-30964 dated Oct. 8, 2018, 4 pages.

Gulf Cooperation Council Examination Report issued in GCC Application No. 2016-30964 dated Mar. 5, 2019, 3 pages.

European Communication Pursuant to Article 94(3) issued in European Application No. 16710076.7-1002 dated Sep. 19, 2019, 5 pages.

European Communication Pursuant to Article 94(3) issued in European Application No. 16710076.7 dated Dec. 4, 2018, 4 pages.

Chinese Office Action issued in Chinese Application No. 201680015107.0 dated Dec. 23, 2019, 17 pages (with English translation).

* cited by examiner

ACTIVATING A WELL SYSTEM TOOL

CROSS-REFERENCE TO RELATED APPLICATION

This application claims priority under 35 U.S.C. § 119 to U.S. Provisional Patent Application Ser. No. 62/130,212, filed Mar. 9, 2015, and entitled "Activating a Well System Tool," the entire contents of which are incorporated herein by reference.

TECHNICAL BACKGROUND

This disclosure relates to activating a well system tool and more particularly, to remotely activating a well system tool in an emergency condition.

BACKGROUND

In some well control incidents, such as those associated with well blow outs, fires, or otherwise, rig personnel have sufficient time to make the well secure by following predetermined operating procedures. Such operating procedures may involve shutting a well in, for example, preventing a hydrocarbon fluid from escaping the well bore or casing at a terranean surface. For example, a shut-in during a drilling operation may include stopping rotation of a drill string, raising or lowering the drill string with drilling fluid pump(s) on until it is spaced out, stopping the drilling fluid pump(s), checking for hydrocarbon fluid production, and if evidence of production is apparent, closing a valve (for example, annular, shear ram, blind ram, pipe ram) with the intension of preventing drilling fluid and hydrocarbons leaving the well except under controlled conditions. Once the well has been safely shut-in, pressures and volumes can be monitored to determine if the well has "kicked," whereby further well control measures are often required. Otherwise, the well can be opened up for continued drilling operations. In some situations, however, well personnel may need to quickly abandon a rig prior to implementation and confirmation of such shut-in operations.

SUMMARY

The present disclosure relates to a remotely-activated well shut-in system that is operable to remotely activate a well shut-in from a location remote from a rig when rig evacuation is occurring or has occurred. In a general implementation, a well system includes a local control unit configured to communicably couple to a well shut-in assembly at a well site, the well shut-in assembly operable to shut-in a wellbore based on a command from the local control unit; and a remote control unit configured to wirelessly communicate a line-of-sight airborne wireless signal, at a location remote from the local control unit and the well site, to initiate the command from the local control unit to the well shut-in assembly.

In an aspect combinable with the general implementation, the well shut-in assembly includes a BOP stack that includes a preventer configured to shut-in the wellbore to prevent hydrocarbon fluid egress from the wellbore; and a BOP power unit that is communicably coupled to the local control unit.

In another aspect that is combinable with any of the previous aspects, the BOP power unit includes a hydraulic power unit that is fluidly coupled to the preventer of the BOP stack.

In another aspect that is combinable with any of the previous aspects, the local control unit is communicably coupled to at least one control valve of the hydraulic power unit.

In another aspect that is combinable with any of the previous aspects, the command from the local control unit is operable to adjust the at least one control valve of the hydraulic power unit.

In another aspect that is combinable with any of the previous aspects, the line-of sight airborne wireless signal includes at least one of a radio frequency signal, a cellular signal, a Wi-Fi signal, or a satellite signal.

In another aspect that is combinable with any of the previous aspects, the local control unit is configured to transmit wireless data to the remote control unit and receive wireless data from the remote control unit, the wireless data transmitted to the remote control unit from the local control unit including at least one of: a confirmation of receipt of the command by the well shut-in assembly, a confirmation of actuation of the well shut-in assembly, a status of a well shut-in event, or well data.

In another aspect that is combinable with any of the previous aspects, the well data includes at least one of pressure, temperature, or well control system status data associated with the well site.

In another aspect that is combinable with any of the previous aspects, the location remote from the local control unit and the well site includes a distance between one tenth of a mile and ten miles.

In another general implementation, a method for activating a wellbore safety device includes receiving, at a well site, a line-of-sight wireless airborne signal from a remote safety control device located remotely from the well site; based on receipt of the signal, activating a power unit for a wellbore safety device; and based on activation of the power unit, actuating the wellbore safety device to shut in a wellbore at the well site.

In an aspect combinable with the general implementation, the line-of-sight airborne wireless signal is received at a local control unit communicably coupled to the power unit.

In another aspect that is combinable with any of the previous aspects, the wellbore safety device includes a BOP stack that includes a preventer coupled to the power unit, the power unit including a hydraulic power unit that is fluidly coupled to the preventer of the BOP stack.

In another aspect that is combinable with any of the previous aspects, the local control unit is communicably coupled to at least one valve of the hydraulic power unit.

Another aspect that is combinable with any of the previous aspects further includes, based on receipt of the signal, generating a command from the local control unit operable to adjust the at least one valve of the hydraulic power unit.

Another aspect that is combinable with any of the previous aspects further includes based on adjusting the at least one valve of the hydraulic power unit, shutting-in the wellbore with the preventer; and preventing hydrocarbon fluid egress from the wellbore with the preventer.

Another aspect that is combinable with any of the previous aspects further includes wirelessly transmitting, from the local control, data to the remote control unit, the data transmitted to the remote control unit from the local control unit including at least one of: a confirmation of receipt of the command by the wellbore safety device, a confirmation of actuation of the wellbore safety device, a status of a well shut-in event, or well data.

In another aspect that is combinable with any of the previous aspects, the well data includes at least one of pressure, temperature, or well control equipment status data associated with the well site.

In another aspect that is combinable with any of the previous aspects, receiving, at a well site, a line-of-sight wireless airborne signal from a remote safety control device located remotely from the well site includes receiving, at the well site, the line-of-sight wireless airborne signal from the remote safety control device located a distance between one tenth of one mile and ten miles.

In another general implementation, a remotely-activated well shut-in system includes a BOP stack including at least one preventer; a hydraulic power unit fluidly coupled to the preventer; a local control unit communicably coupled to the hydraulic power unit; and a remote control unit configured to wirelessly communicate a line-of-sight airborne wireless signal, at a location remote from the local control unit, to initiate a command from the local control unit to the hydraulic power unit to actuate the preventer to shut-in a wellbore.

In an aspect combinable with the general implementation, the local control unit is communicably coupled to at least one valve of the hydraulic power unit, and the command from the local control unit is operable to adjust the at least one valve of the hydraulic power unit.

In another aspect that is combinable with any of the previous aspects, the preventer is configured to shut-in the wellbore to prevent hydrocarbon fluid egress from the wellbore.

In another aspect that is combinable with any of the previous aspects, the local control unit is configured is transmit wireless data to the remote control unit, the wireless data transmitted to the remote control unit from the local control unit including at least one of: a confirmation of receipt of the command by the BOP stack, a confirmation of actuation of the BOP stack, a status of a well shut-in event, well data, or well control equipment status.

In another aspect that is combinable with any of the previous aspects, the well data includes at least one of pressure, temperature, or well control equipment status data associated with the well site.

Various implementations of a remotely-activated well shut-in system may include one, some, or all of the following features. For example, a remotely-activated well shut-in system may provide additional operational safety through the ability to function part of a well safety device (for example, a preventer) at a safe distance (for example, yards to miles) from a drilling rig. As another example, the remotely-activated well shut-in system may allow for a rig crew to evacuate a drill site location, while also providing an ability to monitor or monitor and function a safety device to shut-in and isolate the well until such time that emergency crews or suitably trained third party personnel may enter the proximity of the rig-site. As a further example, the remotely-activated well shut-in system may allow remote shut-in for a terranean surface based well during a time period (minutes, hours, days) when the well is considered out of control. As an even further example, the remotely-activated well shut-in system may facilitate monitoring of an actuated safety device (for example, preventer or other safety device) from a safe distance from an out of control well. The remotely-activated well shut-in system may also increase a probability of being able to shut-in the well during a well control incident. As yet another example, the remotely-activated well shut-in system may be used with a "dry tree" (for example, land-based or shallow water surface deployed) BOP system. Further, the remotely-activated well shut-in system may be an independent system that can be used to remotely-activate a safety device in either a new integrated BOP control system construction (for example, new BOP stack) or retrofit well construction (for example, retrofit BOP stack and HPU/Controls).

Various implementations of a remotely-activated well shut-in system may include one, some, or all of the following features. For example, the remotely activated well shut-in system offers increased levels of operability through the potential use of more robust components such as, but not limited to umbilical hoses, fittings and a hostile environment protected HPU and LCU to allow continued operation in the event of hydrocarbon release and ignition at the terranean level. The system improves safety by allowing users to identify and proceduralize the rig crew evacuation prior to that which would be achievable through conventional methodology when complex and stressful decision making (for example, a "should I stay or should I go" decision) is required, often at short notice. The remotely activated well shut-in system can be used with an additional single ram system to comprise an independent, additional rig safety system or it can be integrated with the existing equipment to supplement the functionality of such package. The remotely activated well shut in system utilizes a secure industrial wireless communications system to ensure the risk of false activation is minimized. The remotely activated well shut-in system can utilize one or more remote control units to function and monitor the well and well control system status. Portable remote control units can be assigned to key operational personnel or packaged to be located at fixed locations on predicted evacuation routes such as muster or lifeboat stations offshore or a camp location onshore.

The details of one or more implementations of the present disclosure are set forth in the accompanying drawings and the description infra. Other features and advantages of the present disclosure will be apparent from the description and drawings, and from the claims.

DETAILED DESCRIPTION

The present disclosure relates to a remotely-activated well shut-in system that is operable to remotely activate a well shut-in from a location remote from a rig when rig evacuation is occurring or has occurred. In some aspects, the remotely-activated well shut-in system includes a local control unit operable to activate a BOP power unit (for example, a hydraulic power unit or electrical power unit) in order to actuate a preventer to shut-in the well. In some aspects, the remotely-activated well shut-in system includes a remote control unit operable to transmit a signal to the local control unit to initiate the shut-in procedure. In some cases, the remote control unit initiates the shut-in procedure through a wireless communication remote from the rig by tens to hundreds of yards, a mile, or more than several miles, to ensure safety of the rig personnel. In some aspects, the remotely-activated well shut-in system may initiate the shut-in procedure of a land-based or shallow water well through line-of-sight (or substantial line-of-sight) wireless communication or wireless communications that do not require to be line of sight.

Figure 1:
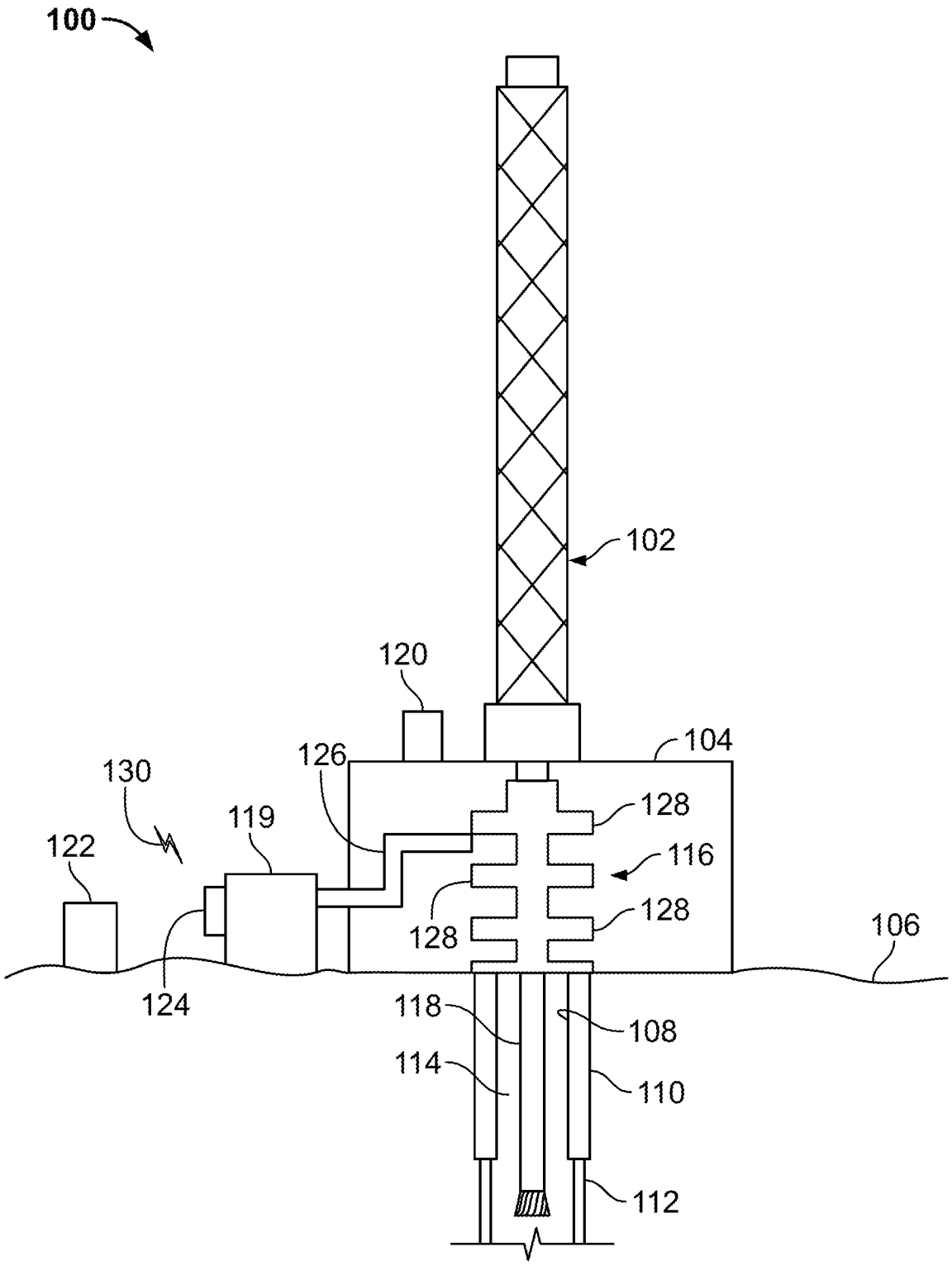
FIG. 1 illustrates a schematic view of an example well system that includes a drilling rig and remotely activated well shut-in system.

FIG. 1 illustrates a schematic view of an example rig and well system 100 that includes at least a portion of a remotely activated well shut-in system. As depicted, the well system 100 includes a workover or drilling rig 102 with a rig floor 104 that is positioned on or above the earth's surface 106 (for example, a terranean surface or a sub-sea surface) and extends over and around a wellbore 108 that penetrates a subterranean formation for the purpose of recovering hydrocarbons. The wellbore 108 may be drilled into the subterranean formation using any suitable drilling technique. The illustrated wellbore 108 extends substantially vertically (that is, vertical as designed) away from the earth's surface 106 over a vertical wellbore portion 116. In alternative operating environments, all or portions of the wellbore 108 may be vertical, deviated at any suitable angle, horizontal, curved or both. The wellbore 108 may be a new wellbore, an existing wellbore, a straight wellbore, an extended reach wellbore, a sidetracked wellbore, a multi-lateral wellbore, and other types of wellbores for drilling and completing one or more production zones. Further the wellbore 108 may be used for both producing wells and injection wells, and may be completely cased (with a conductor casing 110, surface casing 112, and other casings), partially cased (for example, with only the conductor casing 110 and surface casing 112), or open hole (for example, uncased) or variations thereof.

A wellbore tubular string 118 may be lowered into the subterranean formation for a variety of purposes (for example, drilling, intervening, injecting or producing fluids from the wellbore, workover or treatment procedures, or otherwise) throughout the life of the wellbore 108. In this illustrated example, the workover or drilling rig 102 may comprise a derrick with the rig floor 104 through which the wellbore tubular 118 extends downward from the drilling rig 102 into the wellbore 108. The workover or drilling rig 102 may comprise a motor driven winch and other associated equipment for extending the wellbore tubular 118 into the wellbore 108 to position the wellbore tubular 118 at a selected depth. While the operating environment depicted in FIG. 1 refers to a drilling rig 102 for conveying the wellbore tubular 118 within a land-based wellbore 108, in alternative implementations, workover rigs, wellbore servicing units (such as coiled tubing units), and the like may be used to lower the wellbore tubular 118 into the wellbore 108. The wellbore tubular 118 may alternatively be used in other operational environments, such as within an offshore wellbore operational environment where the wellbore 108 extends from the sea to the BOP 116 located within or just below the rig.

As illustrated, the tubing 118 extends through a blowout preventer (BOP) stack 116 that includes one or more (as shown, three) preventers 128. The illustrated BOP stack 116 includes a set of two or more preventers used to ensure secondary pressure control of the wellbore 108. For example, the BOP stack 116 may include one or more ram-type preventers and, optionally, one or more annular-type preventers. Here, the preventers 128 may be ram type including blind, shear and pipe annular type, or otherwise. The particular configuration of the BOP stack 116 preventers may be optimized to provide maximum pressure integrity, safety and flexibility in the event of a well control incident. The BOP stack 116 also includes various spools, adapters, valves, and piping outlets (not shown) to permit the circulation of wellbore fluids under pressure in the event of a well control incident.

Figure 4:
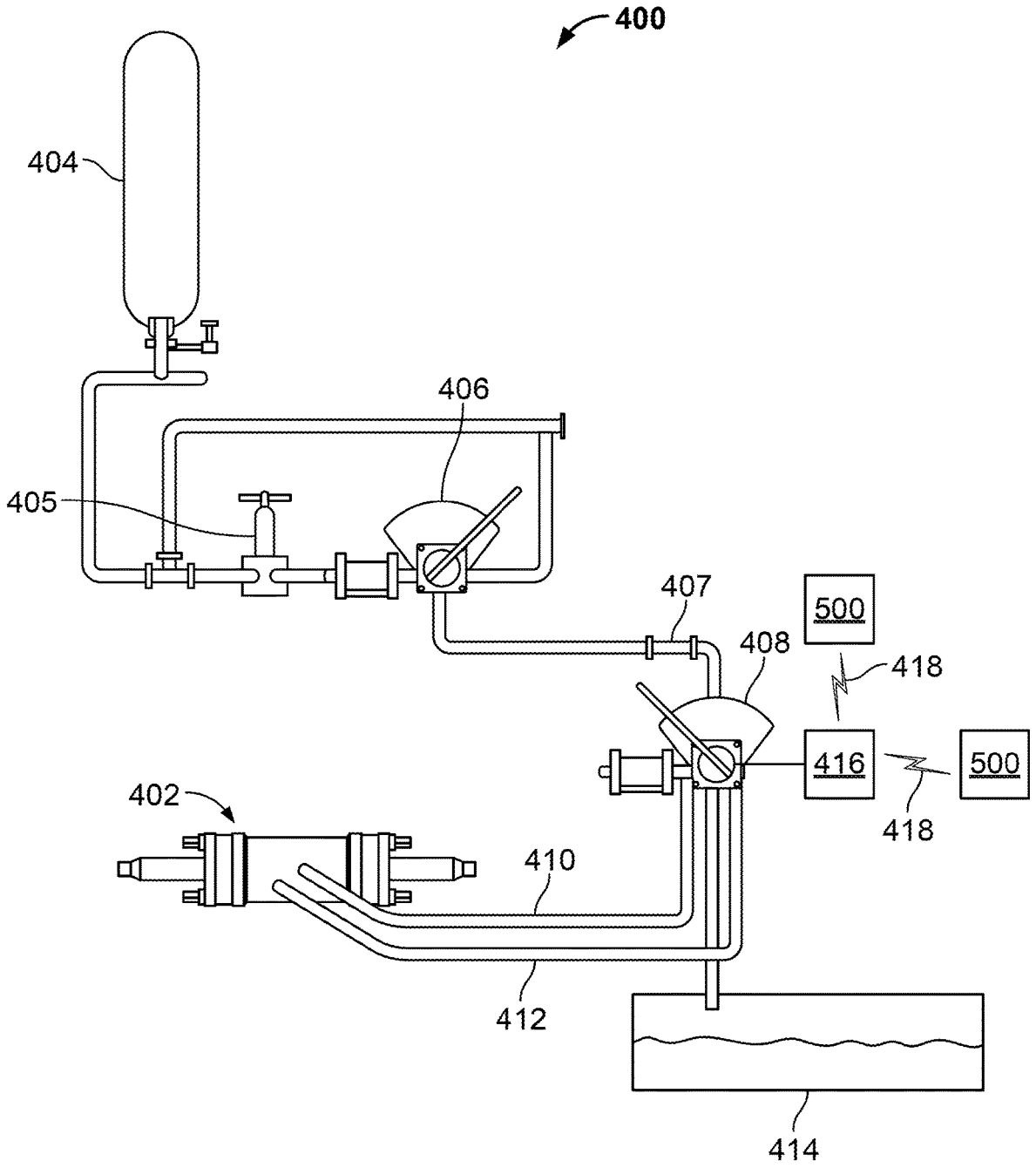
FIG. 4 illustrates a schematic view of a hydraulic power unit for a blowout preventer that includes a local control unit of a remotely-activated well shut-in system.

As illustrated, the preventers 128 of the BOP stack 116 are actuated by, for example, hydraulic fluid that is circulated through control lines 126 from a hydraulic power unit (HPU) 119 (also shown in FIG. 4). The HPU 119, as described in more detail in FIG. 4, is operable to circulate a controlled-pressure hydraulic fluid to one or more of the preventers 128 to actuate the one or more preventers 128 to shut-in the wellbore 108. As illustrated, there may be two or more control panels for the HPU 119. One control panel 120 may be located on the rig floor or in close proximity for easy operation by rig hands during workover, completion, drilling, or operations. Another control panel 122, for instance, may be located away from the rig floor 104 (for example, in 10s or 100s of yards), for example, by a drilling supervisor or tool pusher's office location. The control panel 122, for example, may be used to control the HPU 119 (for example, to actuate one or more of the preventers 128) when circumstances necessitate evacuation from the rig floor area 104.

As shown in FIG. 1, a local control unit (LCU) 124 may be operably coupled to the HPU 119 and form at least a portion of a remotely-activated well shut-in system. The LCU 124 may operate to receive wireless commands 130 from a remote control unit (not shown) and, based on such wireless commands, send one or more signals to the HPU 119 to activate one or more preventers 128. In some implementations, the remote control unit may be a relatively large distance away from the LCU 124, for example, hundreds of yards, over a mile, between 1-5 miles, or over 5 miles (such as 10 miles), and still capable of communicating the wireless commands 130 to the LCU 124. In some implementations, the wireless commands 130 may be one way communication from the remote control unit to the LCU 124. In some implementations, the wireless commands 130 may include two-way communication between the remote control unit and the LCU 124.

In some instances, the wireless commands 130 may be radio frequency (RF) signals, cellular signals, Wi-Fi signals, satellite signals, or other form of airborne wireless communication. In some implementations, the wireless commands 130 may be line-of-sight commands, for example, mostly or only operable to communicate data between the remote control unit and LCU 124 when such components are unimpeded (or substantially unimpeded) by physical obstacles. In some implementations, the wireless commands 130 may operate to communicate data even when the remote control unit and LCU 124 are not in line-of-sight.

Figure 2:
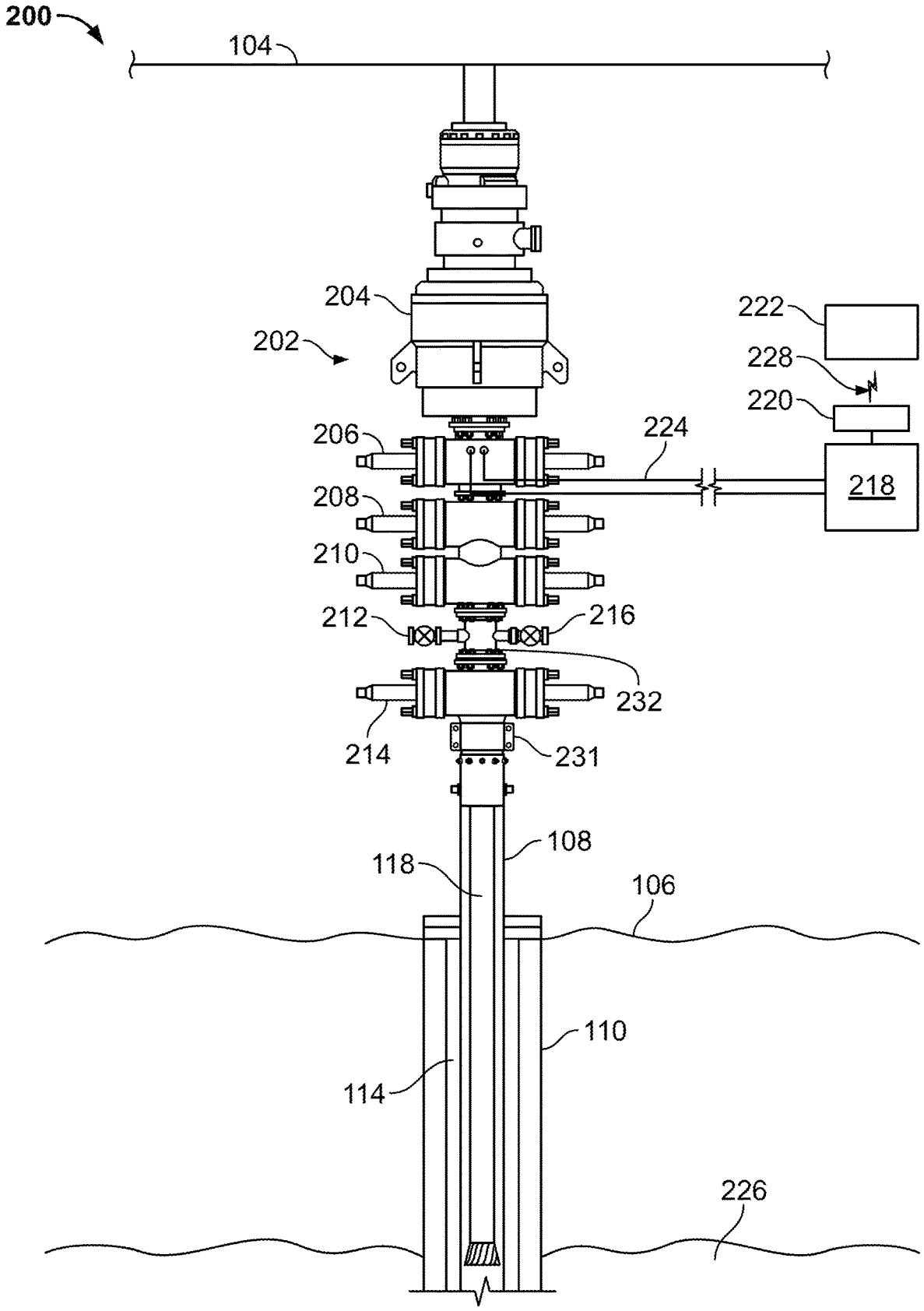
FIG. 2 illustrates a schematic view of an example implementation of a remotely-activated well shut-in system.

FIG. 2 illustrates a schematic view of an example implementation of a remotely-activated well shut-in system 200. The remotely-activated well shut-in system 200 operates to facilitate communication from a remote control unit 222 to a LCU 220 in order to operate an HPU 218. The HPU 218, in turn, operates to actuate one or more preventers in a BOP stack 202 to shut in the wellbore 108. In some implementations, the remote control unit 222 may be located relatively far from the LCU 220 during communication to the LCU 220, for example, greater than a mile, between 1-5 miles, or over 5 miles. The HPU 218 and the LCU 220, in turn, may be located relatively close to the wellbore 108, for example, within 10s or 100s of yards. Thus, the remote control unit 222 may be used to actuate one or more preventers of the BOP stack 202 when circumstances may require that well personnel leave a near vicinity of the wellbore 108 (for example, less than a mile) without shutting-in the well or ensuring that the well is shut-in.

As illustrated in this example, the remotely-activated well shut-in system 200 includes the BOP stack 202 that is coupled with the well 108 that extends into the terranean surface 106. The BOP stack 202 includes an annular preventer 204, ram preventers 206, 208, 210, and 214, a kill line 212, a choke line 216, spool pieces 232, and cross overs 231. The preventers 206, 208, 210, and 214 may be any time of preventer, for example, ram, shear, or pipe. In some implementations, the preventer 214 may be a pipe-type preventer to seal around the tubing string 118 so that, upon well shut-in, the tubing string 118 is not lost in the wellbore 108. In some implementations, the preventers 206, 208, and 210 may be shear preventers that shear the tubing string 118 and seal the well 108 against loss of hydrocarbon fluid to the terranean surface 106. In any event, a well operator may choose the particular type of preventer for preventers 204, 206, 208, 210, and 214.

As illustrated in this example, control lines 224 (for example, hydraulic lines) from the HPU 218 are fluidly coupled to the preventer 206. In some aspects, the preventer 206 may be a retro-fit preventer added for the purpose of providing additional remote shut-in functionality. In this case the HPU 218 is a unit dedicated to the preventer 206 and is additional to the conventional rig HPU and BOP system. The preventer 206 may be added to the BOP stack 202 after fabrication, after installation, or otherwise, specifically to implement the remotely-activated well shut-in system 200. In some implementations, the remotely-activated well shut-in system 200 may be retrofitted to the BOP stack 202.

In some implementations, the preventer 206 may be an original component of the BOP stack 202 (for example, included during fabrication). Further, although shown as connecting the HPU 218 and the preventer 206, the HPU 218 may be fluidly coupled to control any of the preventers in the BOP stack 202. Further, there may be multiple HPUs fluidly coupled to control the multiple preventers in the BOP stack 202. One or more of multiple HPUs may include a separate LCU 220; alternatively, a single LCU 220 may communicate with multiple HPUs.

In the illustrated example, the LCU 220 is communicably coupled to the HPU 218 (for example, hard wired or otherwise) and wirelessly coupled through wireless commands 228 to the remote control unit 222. As noted previously, the wireless commands 228 may be one-way communication (for example, from the remote control unit 222 to the LCU 220) or may be two way communication between the units 220 and 222. As described more fully infra, the remote control unit 222 may be activated to send a particular wireless command 228 to the LCU 220, which in turn would signal (for example, through control wires, hydraulic fluid lines, wireless commands, or otherwise) the HPU 218 to operate the preventer 206 to shut-in the wellbore 108.

Figure 3:
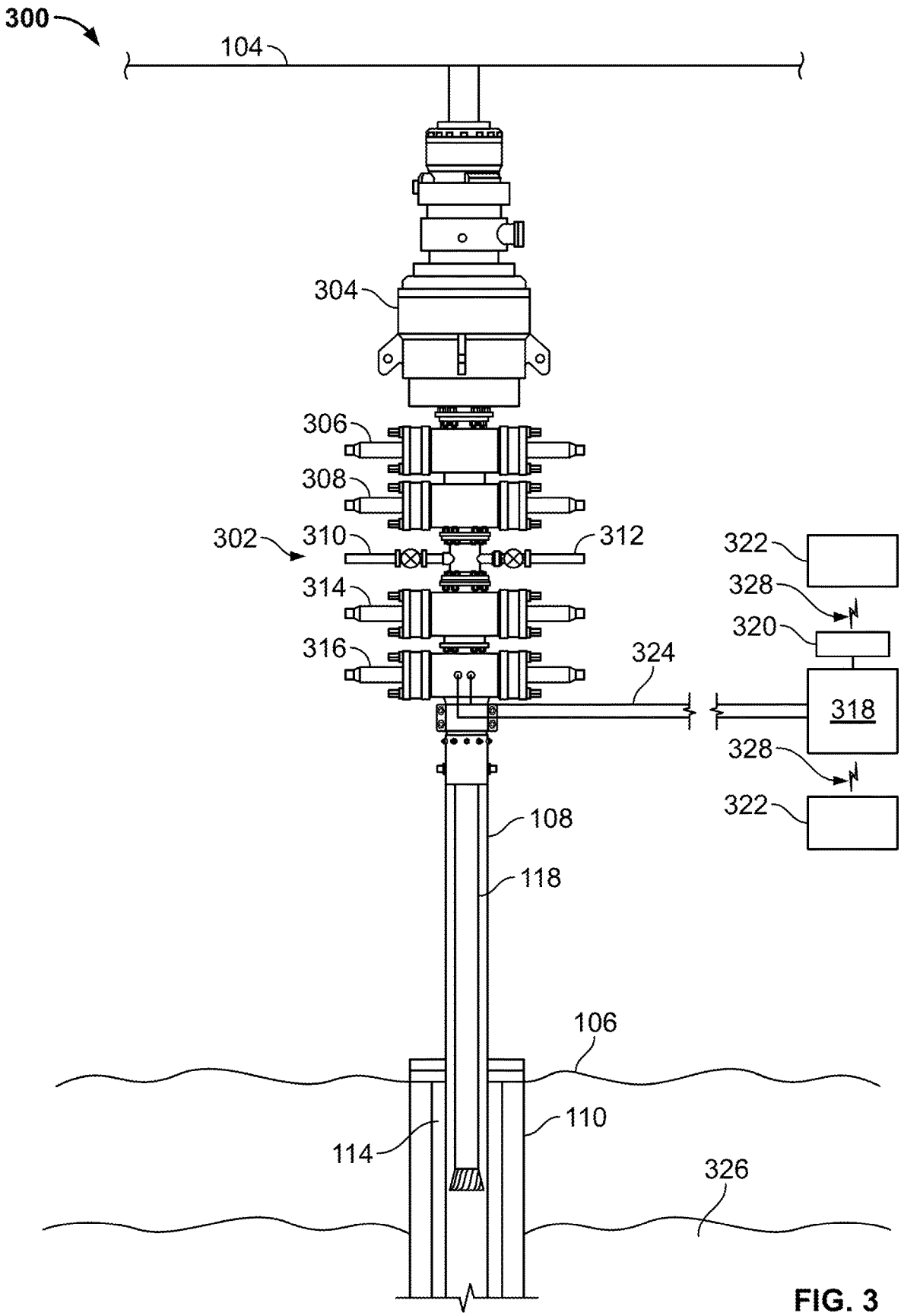
FIG. 3 illustrates a schematic view of another example implementation of a remotely-activated well shut-in system.

FIG. 3 illustrates a schematic view of another example implementation of a remotely-activated well shut-in system 300. The remotely-activated well shut-in system 300 is similar to the remotely-activated well shut-in system 200, but an HPU 318 is hydraulically coupled to a BOP stack 302, below the inlets/outlets for choke lines 312 and kill lines 310. The remotely-activated well shut-in system 300 operates to facilitate communication from a remote control unit 322 to a LCU 320 in order to operate an HPU 318. The HPU 318, in turn, is operated to actuate one or more preventers in a BOP stack 302 to shut in the wellbore 108. In some implementations, the remote control unit 322 may be located relatively far from the LCU 320 during communication to the LCU 320, for example, greater than a mile, between 1-5 miles, or over 5 miles. The HPU 318 and the LCU 320, in turn, may be located relatively close to the wellbore 108, for example, within 10s or 100s of yards. Thus, the remote control unit 322 may be used to actuate one or more preventers of the BOP stack 302 when circumstances may require that well personnel leave a near vicinity of the wellbore 108 (for example, less than a mile) without shutting-in the well or ensuring that the well is shut-in.

As illustrated in this example, the remotely-activated well shut-in system 300 includes the BOP stack 302 that is coupled with wellbore 108 that extends into the terranean surface 106. The BOP stack 302 includes an annular preventer 304, preventers 306, 308, 314, and 316, a kill line 310, and a choke line 312. The preventers 306, 308, 314, and 316 may be any time of preventer, for example, blind, shear, or pipe. In some implementations, the preventer 316 may be a pipe-type preventer to seal around the tubing string 118 so that, upon well shut-in, the tubing string 118 is not lost in the wellbore 108. In some implementations, the preventers 306, 308, and 314 may be ram or shear preventers that shear the tubing string 118 and seal the wellbore 108 against loss of hydrocarbon fluid to the terranean surface 106. In any event, a well operator may choose the particular type of preventer for preventers 304, 306, 308, 314, and 316.

As shown in FIG. 3, the BOP stack 302 includes a kill line 310. The kill line 310 may be fluidly coupled (not shown) to a pump. The BOP stack 302 also includes a choke line 312. The choke line 312 may also be fluidly coupled to a backpressure choke/manifold on the rig floor or elsewhere.

As illustrated, control lines 324 (for example, hydraulic, electrical, or wireless communication lines) from the HPU 318 are coupled to the preventer 316. In some aspects, the preventer 316 may be a retro-fit preventer. The preventer 316 may be added to the BOP stack 302 after fabrication, after installation, or otherwise, specifically to implement the remotely-activated well shut-in system 300. In some implementations, the remotely-activated well shut-in system 300 may be retrofitted to the BOP stack 306. In some implementations, the preventer 316 may be an original component of the BOP stack 306 (for example, included during fabrication).

Further, although shown as connecting the HPU 318 and the preventer 306, the HPU 318 may be fluidly or electrically coupled to control any of the preventers in the BOP stack 302. Further, there may be multiple HPUs (for example, one to one ratio) fluidly or electrically coupled to control the multiple preventers in the BOP stack 302. One or more of multiple HPUs may include a separate LCU 320; alternatively, a single LCU 318 may communicate with multiple HPUs.

In the illustrated example, the LCU 320 is communicably coupled to the HPU 318 (for example, hard wired or otherwise) and wirelessly coupled through wireless commands 328 to the remote control unit 322. As noted previously, the wireless commands 328 may be one-way communication (for example, from the remote control unit 322 to the LCU 320) or may be two way communication between the units 320 and 322. As described more fully infra, the remote control unit 322 may be activated to send a particular wireless command 328 to the LCU 320, which in turn would signal (for example, through control wires, hydraulic fluid lines, wireless commands, or otherwise) the HPU 318 to operate the preventer 306 to shut-in the wellbore 108.

FIG. 4 illustrates a schematic view of an example hydraulic power unit (HPU) 400 for a blowout preventer that can be activated with a local control unit 416 of a remotely-activated well shut-in system. The HPU 400 circulates hydraulic fluid to a preventer 402 in order to actuate the preventer 402. Although this example HPU 400 operates the preventer 402 hydraulically (for example, to actuate the rams or shears in the preventer 402), other forms of HPUs include electrical power HPUs, thermal reaction based or explosives based HPUs, and otherwise. The HPU 400 may be specified to operate under a hydrocarbon release condition at a wellbore.

In this example, the HPU 400 includes (among other components), an accumulator supply tank 404 that stores pressurized hydraulic fluid, a pressure regulator unit 405 that enables fluid pressure reduction or regulation, a regulator or bypass valve 406, a control valve 408, a "close" supply control line 410 that fluidly connects the control valve 408 to the preventer 402, a "open" control line 412 that also fluidly connects the control valve 406 and the preventer 402, and a hydraulic fluid reservoir 414.

In example implementations, the HPU 400 operates as follows to activate the preventer 402. Hydraulic fluid is pumped (with a pump, not shown) from the fluid reservoir 414 to the supply tank 404 and stored under pressure. The usual storage pressure is 3000 or 5000 psi. The stored hydraulic fluid in tank 404 is at a high enough pressure to activate the preventer 402 and is designed to be used as a primary and backup system, for example, when electrical power or rig air supply has failed (thus rendering a pump or pumps inoperative). When the fluid in the tank 404 is needed, regulator valve 406 allows fluid to flow at the required pressure from the tank 404. The control valve 408 (for example, a four-way control valve) is then adjusted to allow flow from the regulator valve 406 to the open or closed hydraulic lines 410 or 412 (depending on functional requirements) and to the preventer 402.

In this example implementation, the LCU 416 is operably coupled to the control valve 408 (for example, to a valve actuator or motor of the valve 408) or the regulator bypass valve 406, or both. Thus, for example a command to activate the preventer 402 may be sent from the LCU 416 to an actuator of the control valve 408 to adjust the valve 408 to allow hydraulic fluid to flow (for example, from the tank 404 through the regulator valve 406) to the preventer 402. As illustrated, a remote control unit 500 (shown in more detail in FIG. 5) communicates wireless commands 418 to the LCU 416, for example, to activate the LCU 416 to actuate the control valve 408. In some aspects, the LCU 416 may wirelessly communicate data, such as a confirmation that the control valve 408 has been actuated, to the remote control unit 500.

In another example implementation, the LCU 416 is operably coupled to the regulator bypass valve 406 (for example, to a valve actuator or motor of the valve 406). Thus, for example a command to activate the preventer 402 may be sent from the LCU 416 to an actuator of the valve 406 to adjust the valve 406 to allow hydraulic fluid to flow. The bypass valve 406 is thus controlled to allow unregulated pressured fluid to "bypass," for example, from the tank 404 through the regulator valve 406, which is set to bypass regulated pressure and apply full system pressure, from tank 404. The bypassed fluid is circulated to the preventer close function line 410. As illustrated, the remote control unit 500 (shown in more detail in FIG. 5) may communicate wireless commands 418 to the LCU 416, for example, to activate the LCU 416 to actuate the bypass valve 406. In some aspects, the LCU 416 may wirelessly communicate data, such as a confirmation that the regulator bypass valve 406 has been actuated, to the remote control unit 500.

In yet another example implementation, the LCU 416 is operably coupled to the regulator bypass valve 406 and the control valve 408. When activated by the remote control unit 500, the LCU 416 may selectively actuate one or both of the valves 406 and 408 to actuate the preventer 402 as previously described.

Figure 5:
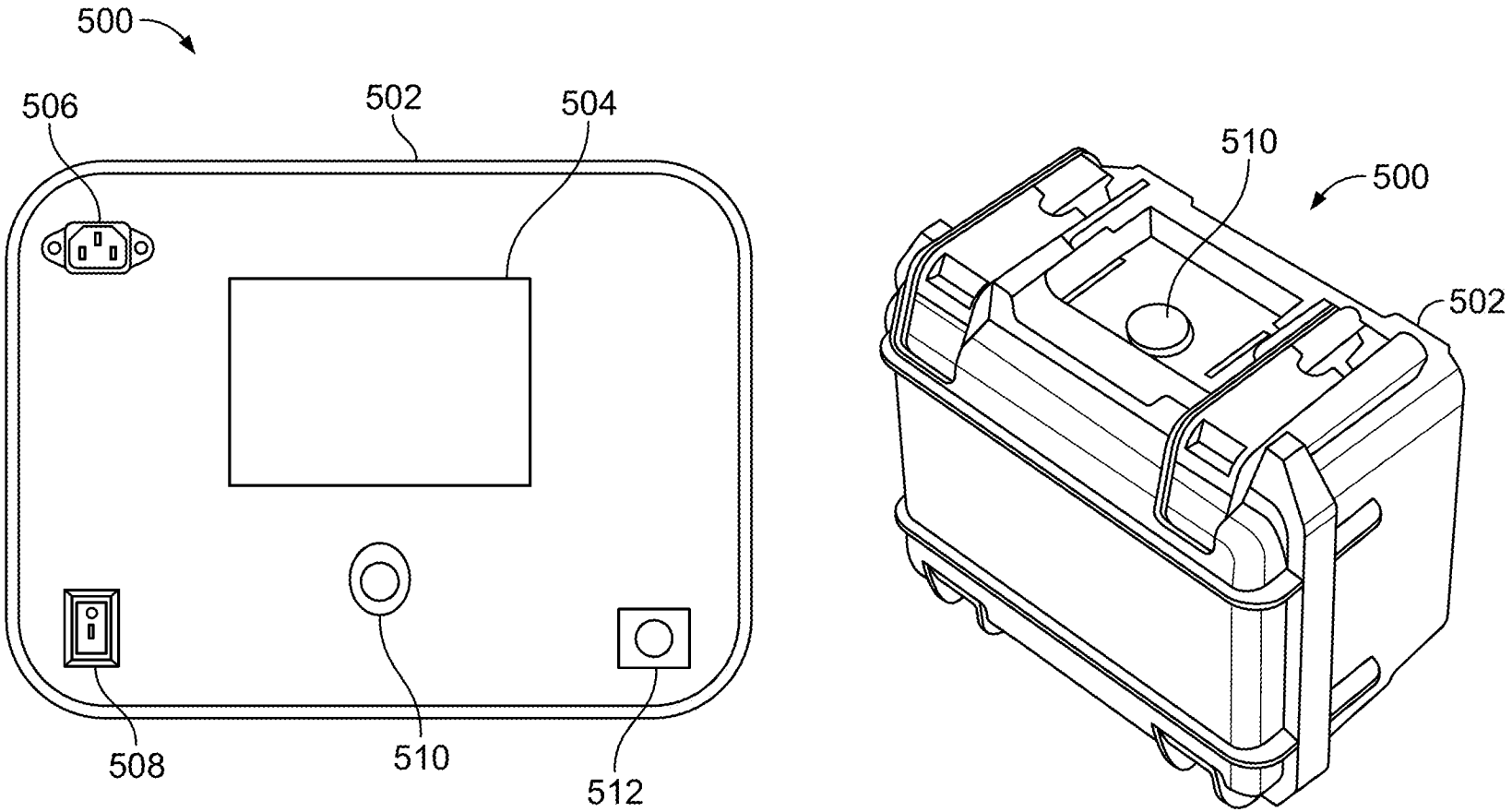
FIG. 5 illustrates an example implementation of a remote control unit of a remotely-activated well shut-in system.

FIG. 5 illustrates an example implementation of a remote control unit 500 of a remotely-activated well shut-in system. As illustrated, the remote control unit 500 includes a case 502 (for example, a ruggedized case) that includes an activation switch 510 that is exposed through the case 502. In some instances, the activation switch 510 may only be exposed by opening the case 502 as well. The activation switch 510 may not be a single point control of activation of a preventer on a BOP stack (such as the preventers/BOP stacks described previously). For example, by pressing the activation switch 510, simultaneously with another key activated switch, button, code entry into screen 504 or other interlock type system or method designed to prevent accidental function activation, a wireless signal may be sent to a local control unit communicably coupled to a hydraulic power unit. The signal commands the local control unit to activate the hydraulic power unit, which in turn, provides hydraulic fluid to a particular preventer of a BOP stack to shut-in a well.

In some aspects, the activation switch 510 may include or be electrically coupled to a wireless transmitter or wireless transceiver of the remote control unit 500. The wireless transmitter or wireless transceiver may facilitate one or more wireless protocols, such as Wi-Fi, cellular, RF, satellite, or otherwise. Wireless transmissions may be secure and protected with a suitable "handshake" between RCU and LCU to prevent accidental activation by 3rd party systems including WIFI, RF, Satellite, cellular, or otherwise. The wireless transmitter or wireless transceiver may be line-of-sight transmission, for example, only operable to communicate data between the remote control unit and local control unit when such components were unimpeded (or substantially unimpeded) by physical obstacles. The wireless transmitter or wireless transceiver may be operate to communicate data even when the remote control unit and local control unit are not in line-of-sight.

The remote control unit 500 also includes a display 504 to display information, such as information received from a local control unit through wireless communication, or other information (for example, diagnostic, testing, or otherwise). In some aspects, the display 504 may confirm that a "close" command has been sent to the local control unit to activate the hydraulic power unit to "close" a preventer in a BOP stack. In some aspects, the remote control unit 500 and display 504 facilitate and display a health check of the RCU 500, a health check of the communication link with the local control unit, a confirmation of function "close" and feedback on volumes pumped vs. expected volumes or other such method to increase confidence that the BOP stack has shut-in the well.

Further, in some aspects, the remote control unit 500 or the LCU may include an automated functionality to automatically send the "close" signal in the event of, for example, excess heat detection (explosion), gas detection, or other operationally or procedurally triggering response. Additional channels of data collected from instrumentation around the local wireless control unit can be transmitted to the remote control unit 500 for display on the display 504 to, in some instances, facilitate a more informed decision at a safe distance from the rig site.

In the illustrated example of remote control unit 500, a power input 506 is provided to allow for electrical power to be provided to the remote control unit 500. In some aspects, the power input 506 may recharge an independent power source (for example, batteries, capacitor, or otherwise) that can power the remote control unit 500 decoupled from a wired power source. The remote control unit 500 also included, in this implementation, an on-off button 508 and a safety lock 512. The on-off button 508 may allow an operator of the remote control unit 500 to turn the unit on or off, for example, to save the stored power of the unit 500. The safety lock 512 may be provided to prevent accidental system function, for example, accidental transmission of a "close" signal to a local control unit. The safety lock 512 may be a switch, button, code entry into screen 504 or other interlock type, system or method designed to prevent accidental function activation.

In some aspects, the remote control unit 500 (as well as a local control unit such as LCUs 124, 220, 320, of 416) may be or include a system of one or more processors that can be configured to perform particular actions by virtue of having software, firmware, hardware, or a combination of them installed on the remote control unit 500 (or local control unit) that in operation causes or cause the system to perform the actions. One or more computer programs, stored in a memory, can be configured to perform particular actions by virtue of including instructions that, when executed by the processors, cause the remote control unit 500 (or local control unit) to perform the actions.

In an example operation according to the present disclosure, during a rig evacuation, one or more designated persons (for example, a rig supervisor and tool pusher) may each possess a remote control unit for a remotely-activated well shut-in system. Additional remote control units may be assigned to other rig personnel or placed at designated locations on or off the rig site. Examples of such locations include but are not limited to an onshore rig camp location or a muster station in an offshore installation. Remote control unit or units may be operable to wirelessly communicate with local control unit of the remotely-activated well shut-in system. In turn, the local control unit may be communicably coupled to a BOP power unit (for example, a hydraulic power unit or otherwise) or a control panel for a BOP power unit or both. The BOP power unit, in turn, may be communicably coupled to at least one preventer of a BOP stack of the rig.

Upon confirmation or initiation of an emergency event or potential for an emergency event (for example, well blow out) and after retreating to a safe range, for example, pre-determined by the expected well conditions and company policies (for example, up to several miles from rig site), the remote control unit may be activated to initiate well shut-in. For example, the remote control unit signals to the local control unit to activate the BOP power unit, which in turn actuates the preventer (for example, a shear, blind, pipe or annular preventer). The well may thus be shut-in or the well control incident may at least be reduced in severity. In some instances, confirmation of preventer actuation may be sent from the local control unit to the remote control unit, along with, in some examples, well and well control data (for example, pressures, temperatures, well control equipment status, and otherwise).

A number of implementations have been described. Nevertheless, it will be understood that various modifications may be made. For example, example operations, methods, and processes described herein may include more steps or fewer steps than those described. Further, the steps in such example operations, methods, and processes may be performed in different successions than that described or illustrated in the figures. Accordingly, other implementations are within the scope of the following claims.

What is claimed is:

1. An on-shore well system, comprising:

a local control unit configured to communicably couple, through a hard-wired connection, to a well shut-in assembly at an on-shore well site, the well shut-in assembly operable to shut-in a wellbore based on a command from the local control unit, the well shut-in assembly comprising:

a BOP stack that comprises a preventer configured to shut-in the wellbore to prevent hydrocarbon fluid egress from the wellbore, and a BOP hydraulic power unit that is communicably coupled through the hard-wired connection to the local control unit, the BOP hydraulic power unit comprising:

a bypass valve communicably coupled through the hard-wired connection to the local control unit, the command comprising a first activation command from the local control unit to the bypass valve to actuate the bypass valve to initiate operation of the preventer, and a control valve communicably coupled through the hard-wired connection to the local control unit, the command comprising a second activation command from the local control unit to the control valve to actuate the control valve to initiate operation of the preventer; and a remote control unit configured to wirelessly communicate a line-of-sight airborne wireless signal, at a location remote from the local control unit and the well site, to initiate the command from the local control unit to the well shut-in assembly, wherein the line-of sight airborne wireless signal is operable to communicate from the remote control unit to the local control unit exclusively through an airborne path between the remote control unit and the local control unit that is unimpeded by one or more physical obstacles, and the local control unit is configured to exclusively receive the line-of-sight airborne wireless signal from the remote control unit in a one-way communication from the remote control unit to the local control unit, and the remote control unit is configured to initiate the line-of-sight airborne wireless signal based on a simultaneous activation of a first activation switch and a second activation switch of the remote control unit.

2. The well system of claim 1, wherein the BOP hydraulic power unit is fluidly coupled to the preventer of the BOP stack, and the first and second activation commands open the bypass valve and the control valve, respectively, to initiate operation of the preventer.

3. The well system of claim 2, wherein the bypass valve is fluidly coupled through a pressure regulator to a supply tank of hydraulic fluid.

4. The well system of claim 3, wherein the control valve is fluidly coupled between the bypass valve and the preventer of the BOP hydraulic power unit.

5. The well system of claim 1, wherein the local control unit is configured to transmit wireless data to the remote control unit and receive wireless data from the remote control unit, the wireless data transmitted to the remote control unit from the local control unit comprising at least one of: a confirmation of receipt of the command by the well shut-in assembly, a confirmation of actuation of the well shut-in assembly, a status of a well shut-in event, or well data.

6. The well system of claim 5, wherein the well data comprises at least one of pressure, temperature, or well control system status data associated with the well site.

7. The well system of claim 1, wherein the location remote from the local control unit and the well site comprises a distance between one tenth of a mile and ten miles.

8. A method for activating a wellbore safety device, comprising:

receiving, at an on-shore well site, a line-of-sight wireless airborne signal from a remote safety control device located remotely from the well site;

based on receipt of the signal, activating a power unit for a wellbore safety device, through a hard-wired connection between a local control unit and the power unit, the wellbore safety device comprising a BOP stack that comprises a preventer coupled to the power unit, the power unit comprising a hydraulic power unit that is fluidly coupled to the preventer of the BOP stack, wherein activating the power unit comprises:

opening a bypass valve of the hydraulic power unit with a first command from the local control unit to the bypass valve based on receipt of the signal, and opening a control valve of the hydraulic power unit with a second command from the local control unit to the control valve based on receipt of the signal; and based on activation of the power unit, actuating the preventer of the BOP stack of the wellbore safety device, through actuation of the bypass valve and the control valve, to shut in a wellbore at the well site, wherein the line-of sight airborne wireless signal communicates from the remote control unit to the local control unit exclusively through an airborne path between the remote control unit and the local control unit that is unimpeded by one or more physical obstacles, and the local control unit is configured to exclusively receive the line-of-sight airborne wireless signal from the remote control unit in a one-way communication from the remote control unit to the local control unit, and the remote control unit is configured to initiate the line-of-sight airborne wireless signal based on a simultaneous activation of a first activation switch and a second activation switch of the remote control unit.

9. The method of claim 8, wherein the line-of-sight airborne wireless signal is received at the local control unit communicably coupled to the power unit.

10. The method of claim 8, further comprising circulating hydraulic fluid from a supply tank of the hydraulic power unit through the open bypass valve and to the open control valve.

11. The method of claim 10, further comprising circulating hydraulic fluid from the open bypass valve, through the control valve, and to the preventer to activate the preventer.

12. The method of claim 11, further comprising:

based on opening the bypass valve and the control valve of the hydraulic power unit, shutting-in the wellbore with the preventer; and preventing hydrocarbon fluid egress from the wellbore with the preventer.

13. The method of claim 8, further comprising wirelessly transmitting, from the local control, data to the remote control unit, the data transmitted to the remote control unit from the local control unit comprising at least one of: a confirmation of receipt of the command by the wellbore safety device, a confirmation of actuation of the wellbore safety device, a status of a well shut-in event, or well data.

14. The method of claim 13, wherein the well data comprises at least one of pressure, temperature, or well control equipment status data associated with the well site.

15. The method of claim 8, wherein receiving, at a well site, a line-of-sight wireless airborne signal from the remote control device located remotely from the well site comprises receiving, at the well site, the line-of-sight wireless airborne signal from the remote safety control device located a distance between one tenth of one mile and ten miles.

16. A remotely-activated well shut-in system, comprising:

a BOP stack comprising at least one preventer;

a hydraulic power unit fluidly coupled to the preventer, the hydraulic power unit comprising:

a first valve fluidly coupled to a hydraulic fluid supply tank through a pressure regulator, and a second valve fluidly coupled to the first valve and the BOP stack;

a local control unit communicably coupled to each of the first and second valves of the hydraulic power unit through a wired connection; and a remote control unit configured to wirelessly communicate a line-of-sight airborne wireless signal, at a location remote from the local control unit, to initiate a command from the local control unit to the hydraulic power unit to actuate the preventer to shut-in a wellbore at an on-shore wellsite, wherein the line-of sight airborne wireless signal is operable to communicate from the remote control unit to the local control unit exclusively through an airborne path between the remote control unit and the local control unit that is unimpeded by one or more physical obstacles, and wherein each of the first and second valves are openable based on the command from the local control unit to circulate hydraulic fluid to the BOP stack to actuate the preventer, and wherein the local control unit is configured to exclusively receive the line-of-sight airborne wireless signal from the remote control unit in a one-way communication from the remote control unit to the local control unit, and wherein the remote control unit is configured to initiate the line-of-sight airborne wireless signal based on a simultaneous activation of a first activation switch and a second activation switch of the remote control unit.

17. The remotely-activated well shut-in system of claim 16, wherein the second valve is fluidly coupled to the preventer through a first conduit and a second conduit, and the second valve is fluidly coupled to a hydraulic fluid reservoir.

18. The remotely-activated well shut-in system of claim 16, wherein the preventer is configured to shut-in the wellbore to prevent hydrocarbon fluid egress from the wellbore.

19. The remotely-activated well shut-in system of claim 16, wherein the local control unit is configured is transmit wireless data to the remote control unit, the wireless data transmitted to the remote control unit from the local control unit comprising at least one of: a confirmation of receipt of the command by the BOP stack, a confirmation of actuation of the BOP stack, a status of a well shut-in event, well data, or well control equipment status.

20. The remotely-activated well shut-in system of claim 19, wherein the well data comprises at least one of pressure, temperature, or well control equipment status data associated with the well site.

21. The well system of claim 1, wherein a distance between the local control unit and the well shut-in assembly is 100 yards or less, and a distance between the local control unit and the remote control unit is between 0.5 and 5 miles.

22. The well system of claim 1, wherein at least one of the first or second activation switches comprises a code entry.

* * * * *